US005138296A

United States Patent [19]

Borchardt et al.

[11] Patent Number: 5,138,296

[45] Date of Patent: Aug. 11, 1992

[54] ELECTRIC SWITCH

[75] Inventors: Robert E. Borchardt, Brown Deer; Eberhardt H. Schreiber, Montello; Grant W. Nelson, Milwaukee, all of Wis.

[73] Assignee: Allen-Bradley Company, Inc., Milwaukee, Wis.

[21] Appl. No.: 806,963

[22] Filed: Dec. 12, 1991

[51] Int. Cl.[5] ..... H01H 85/00; H01H 71/16

[52] U.S. Cl. ..... 337/10; 337/52; 337/64; 200/400

[58] Field of Search ..... 337/7, 8, 10, 11, 63, 337/64, 62, 52; 200/400, 436, 337

[56] References Cited

U.S. PATENT DOCUMENTS 4,748,431 5/1988 Saunders et al. ..... 337/10
4,851,621 7/1989 Borchardt et al. .
4,916,268 4/1990 Micoud ..... 200/400

*Primary Examiner*—Harold Broome
*Attorney, Agent, or Firm*—Quarles & Brady

[57] ABSTRACT

The present invention is an electric switch for switching individual phases of multi-phase AC electric power. The switch has at least one pair of fixed terminals with each terminal of the pair having an ear extending upward in a vertical plane. The switch also has a conducting device with contacts that extend downward in the vertical plane corresponding to the fixed terminals. Moving contacts are mounted to an axially translatable contact carrier and engage contemporaneously in the vertical plane with the contacts from the conducting device and the fixed terminals when the contact carrier slides into an "on" position. Electrical power is then able to flow from the line-side fixed terminal, through the conducting device, to the load-side terminal. The contact carrier is translated axially by the drive mechanism. The drive mechanism employs over-center shifting and lost-motion switching technology to prevent the switch from being in a partially "on" position. An auxiliary switch can be mounted to the switch and switched "on" and "off" contemporaneously with the electric switch.

13 Claims, 13 Drawing Sheets

FIG. 7
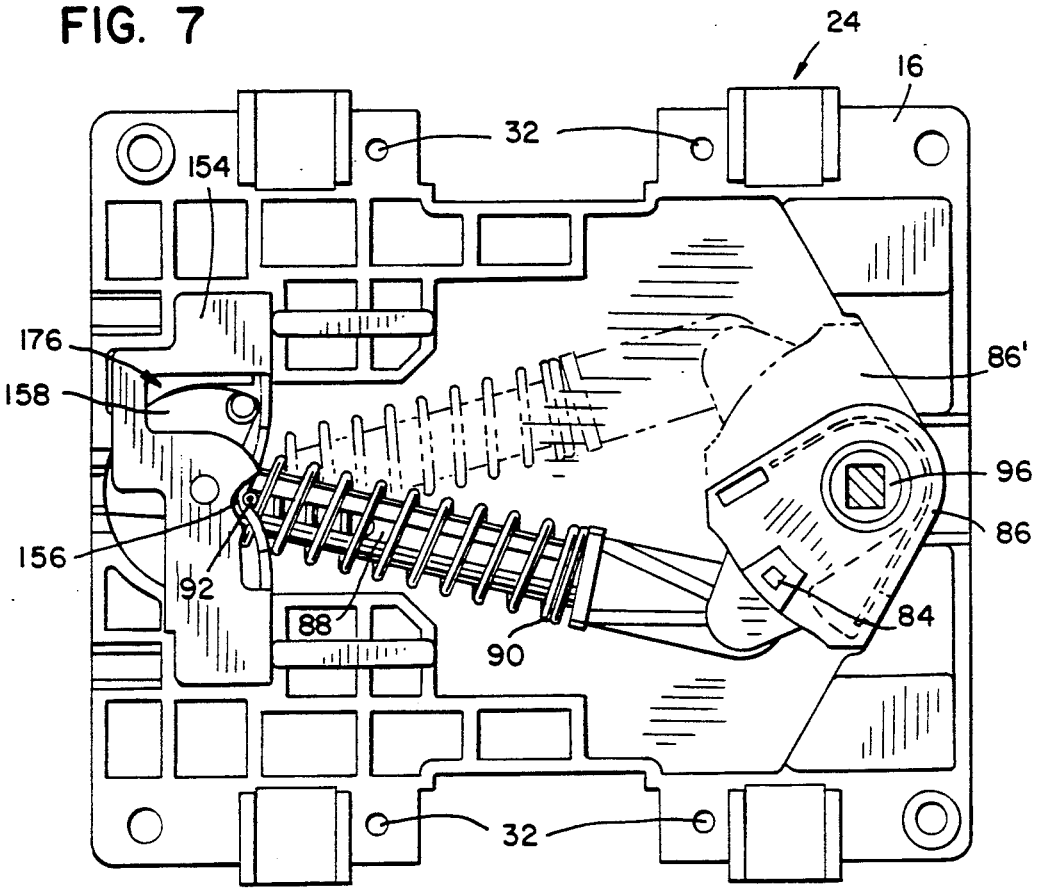
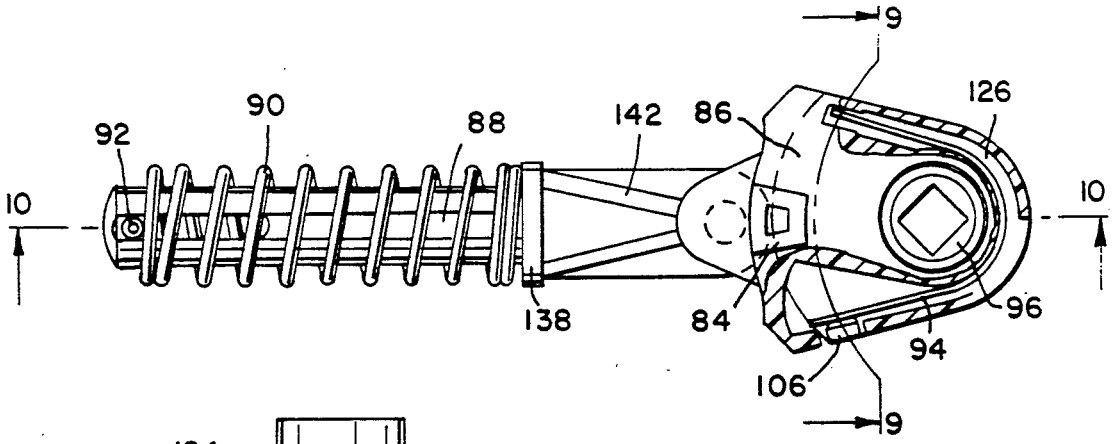
FIG. 8
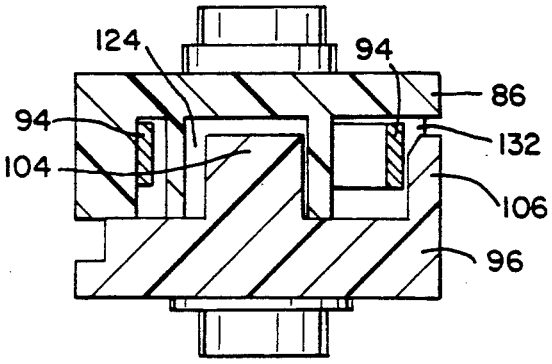
FIG. 9

FIG. 10
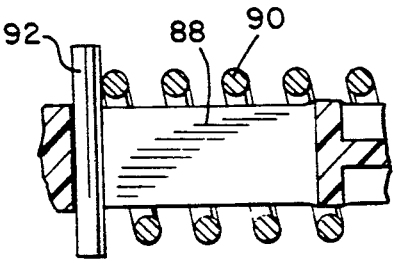
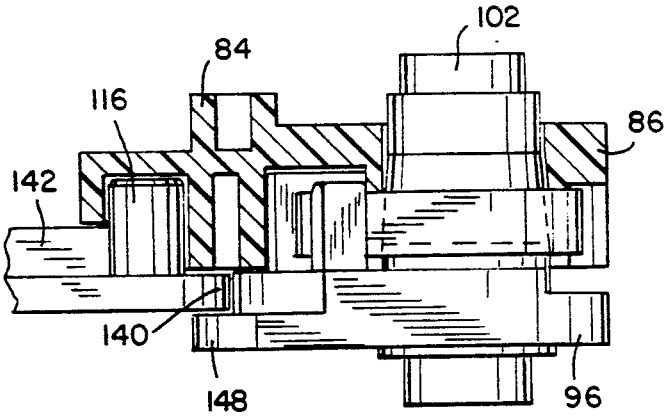
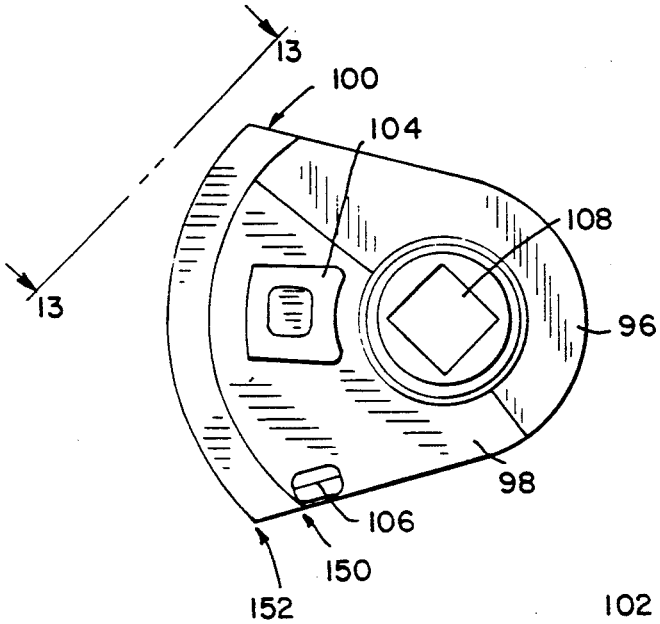
FIG. 11
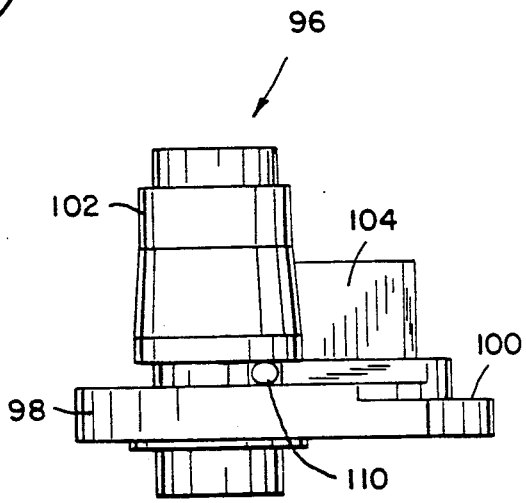
FIG. 12
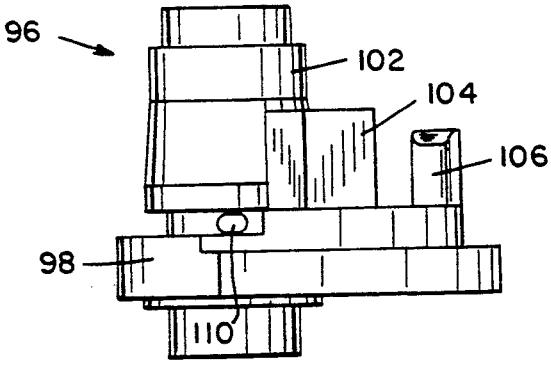
FIG. 13

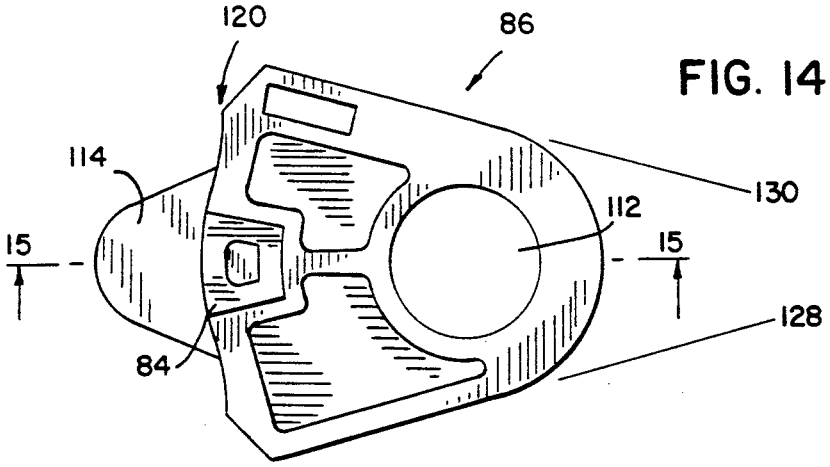
FIG. 14
FIG. 15
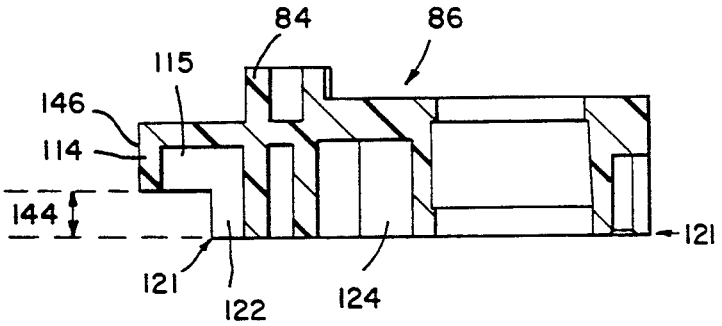
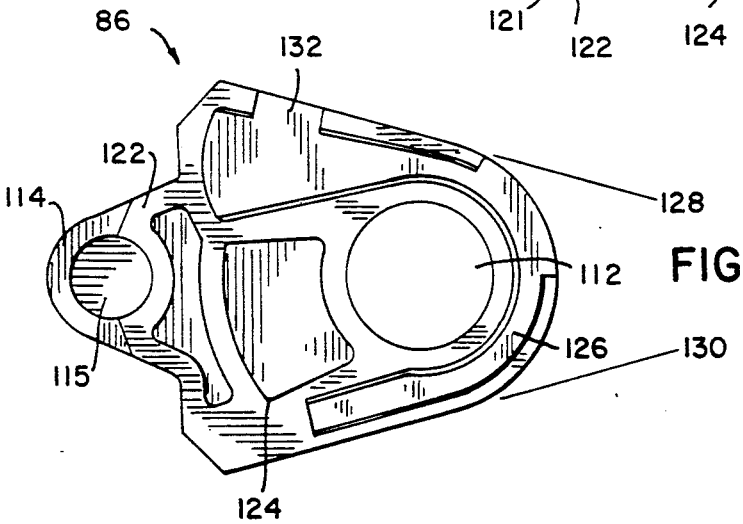
FIG. 16
FIG. 17
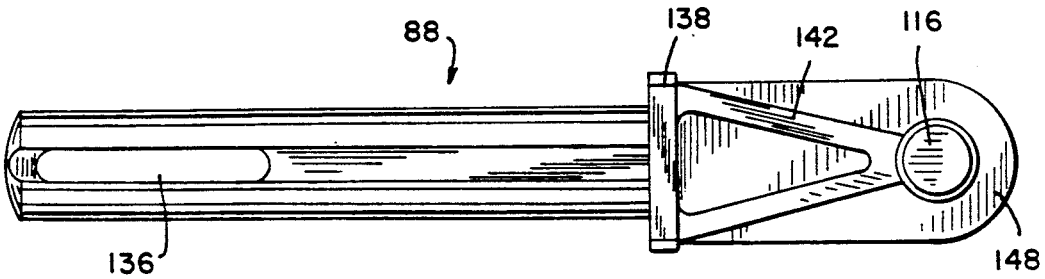

FIG. 18
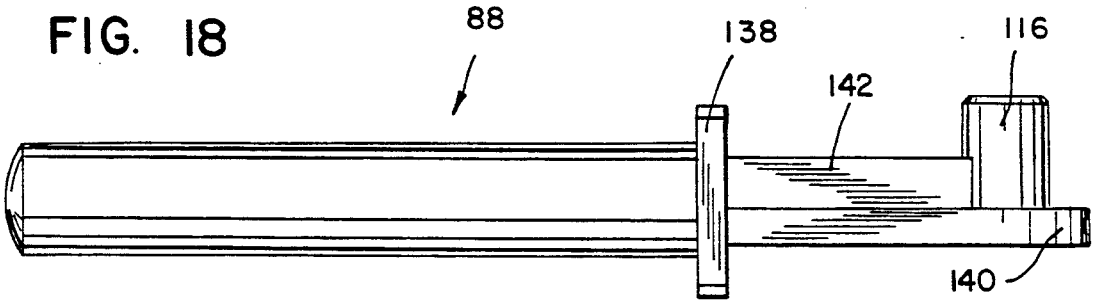
FIG. 19
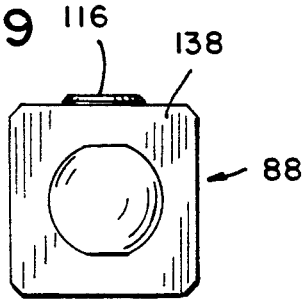
FIG. 20
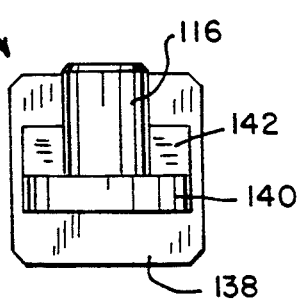
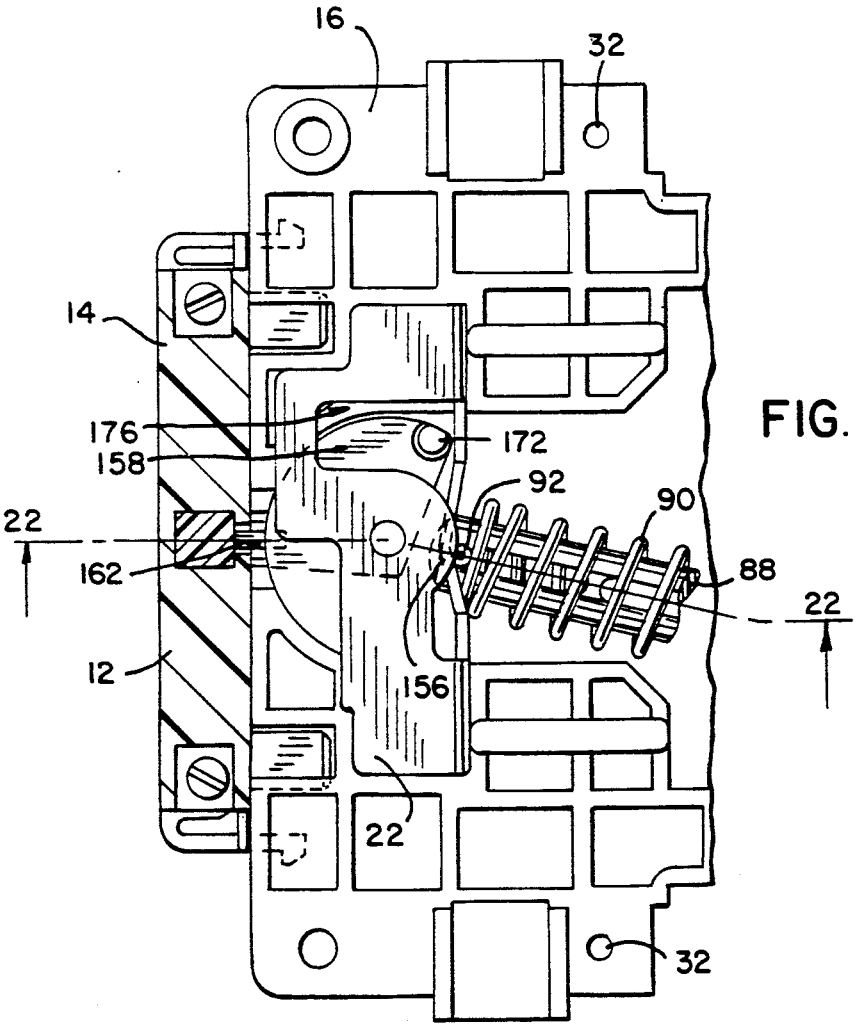
FIG. 21

FIG. 22
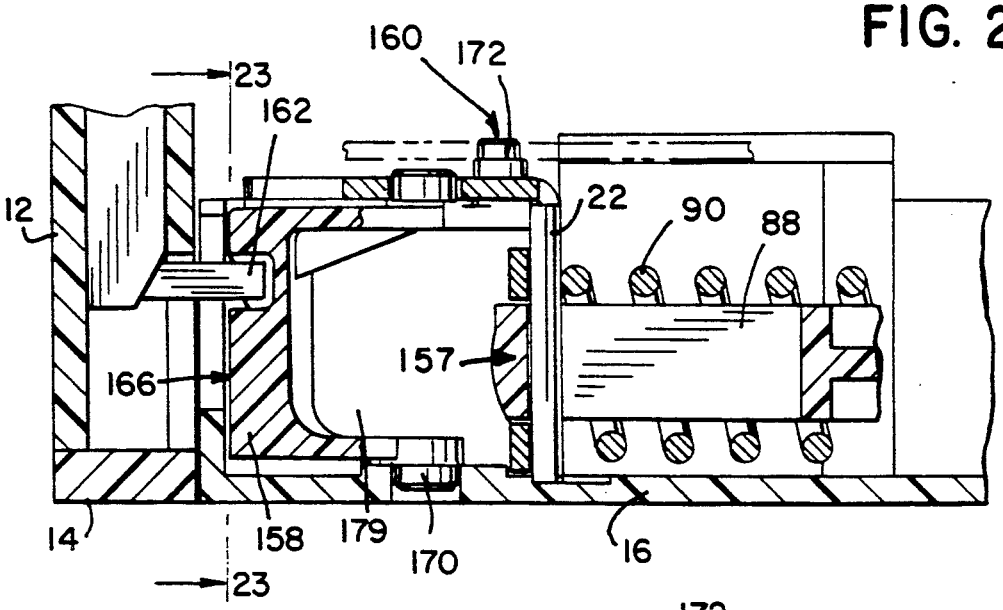
FIG. 23
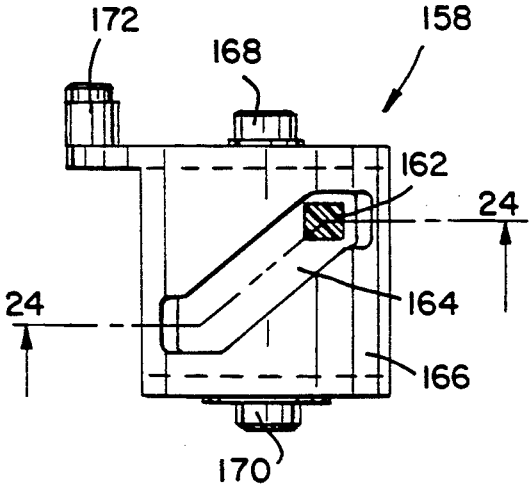
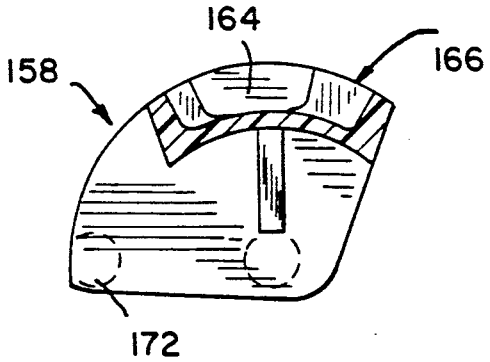
FIG. 24
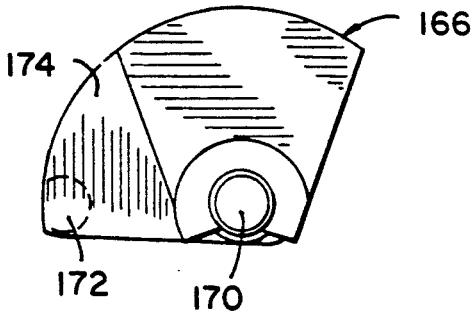
FIG. 25

FIG. 26
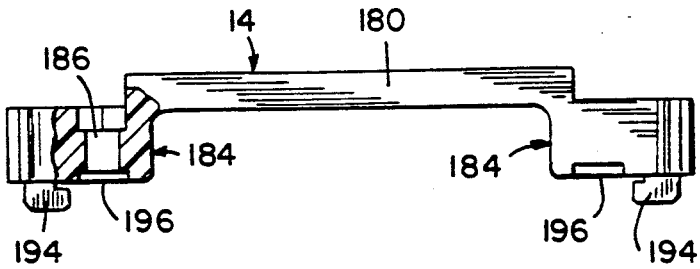
FIG. 27
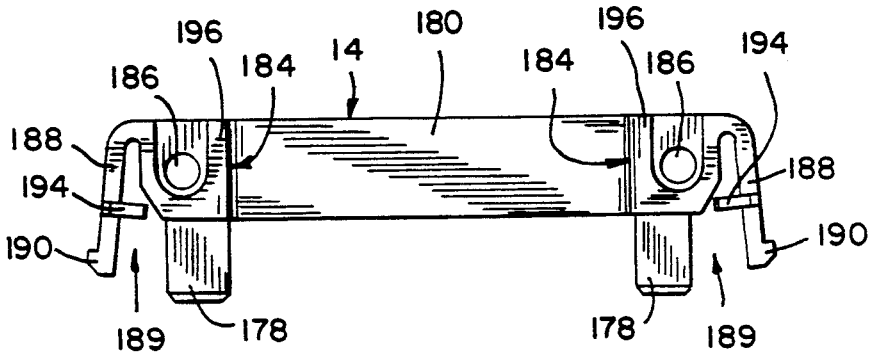
FIG. 28
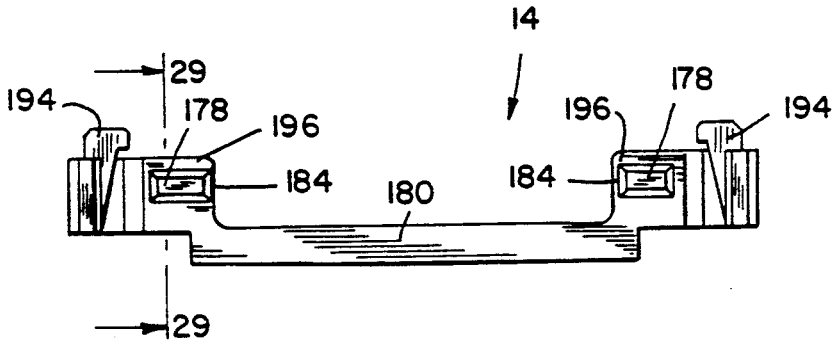
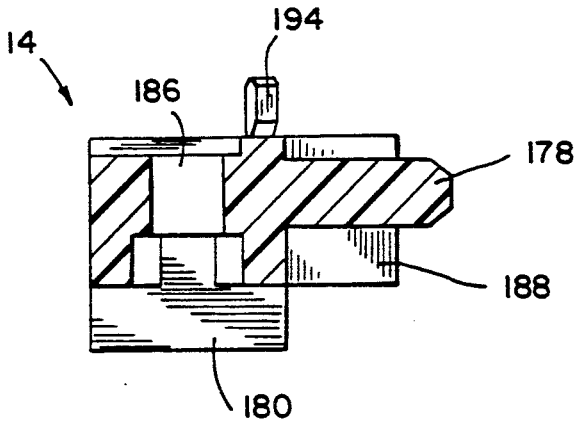
FIG. 29

FIG. 30
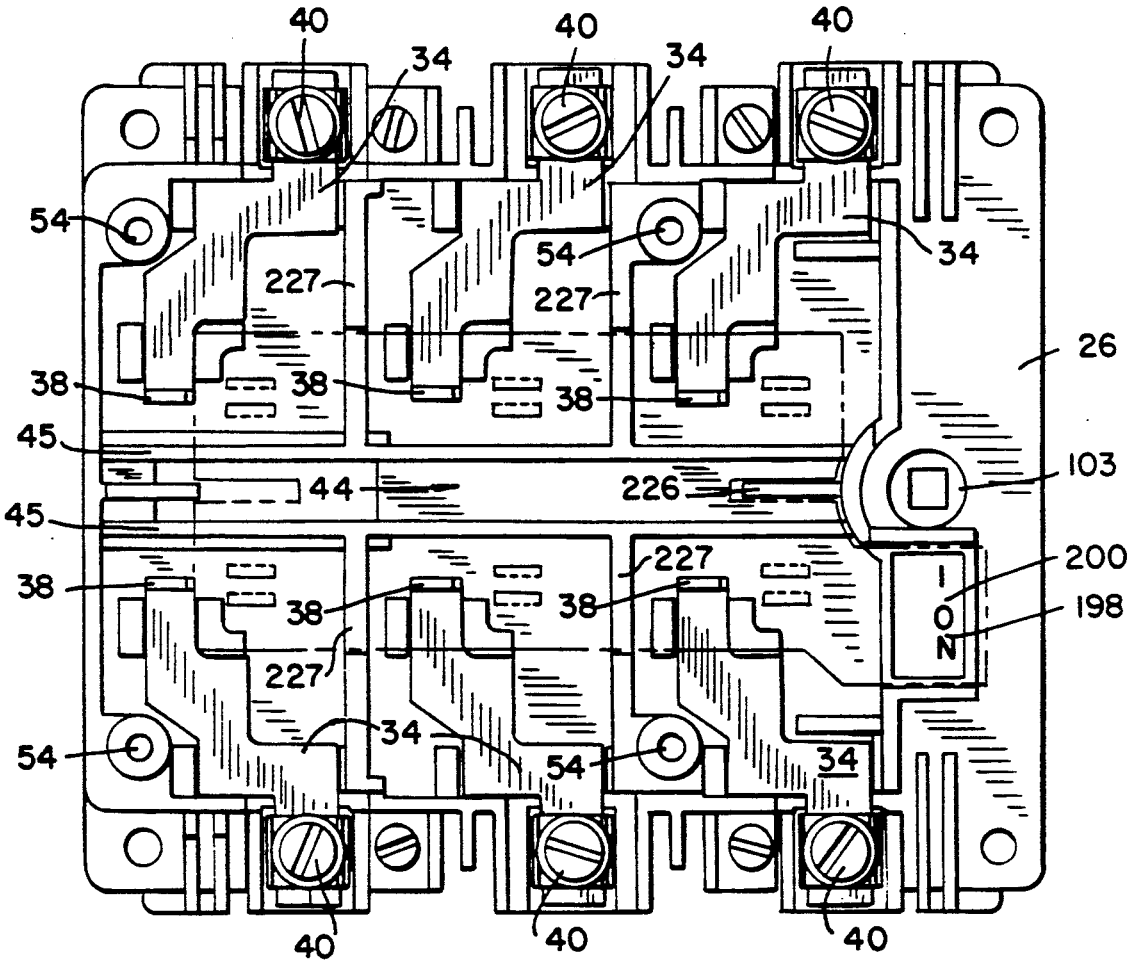
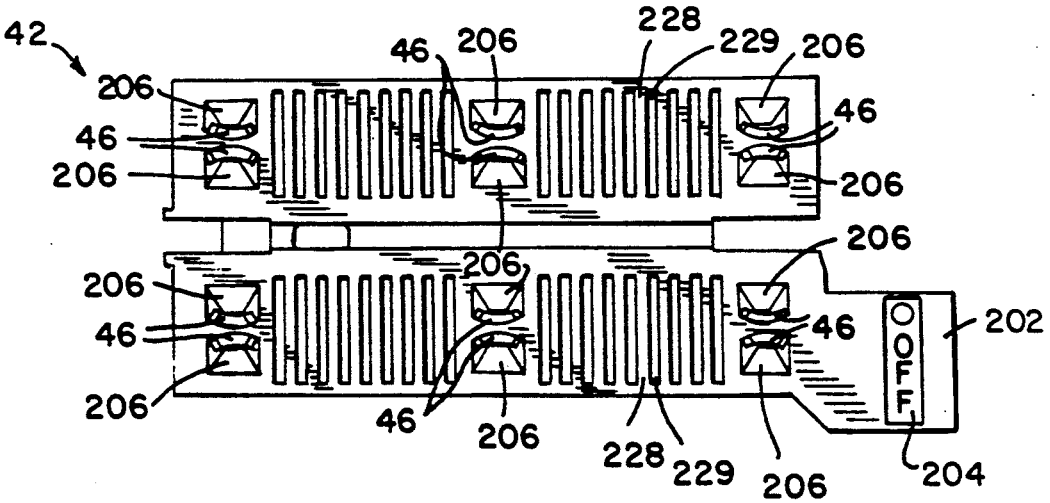
FIG. 31

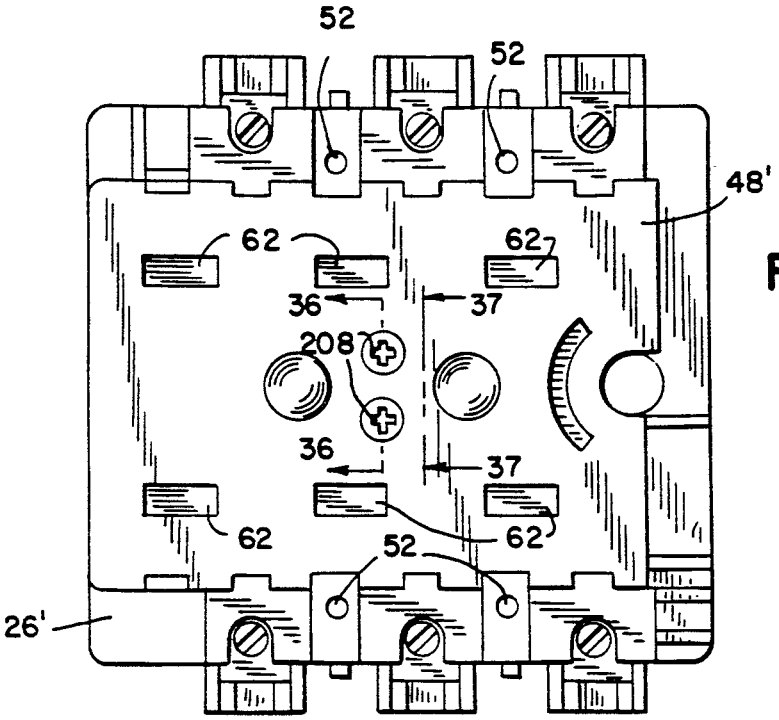
FIG. 32
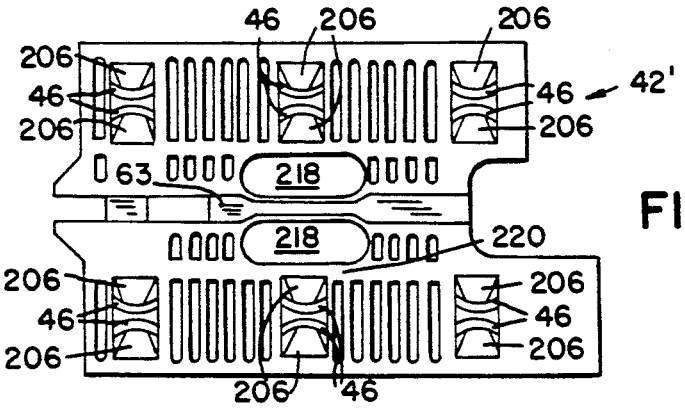
FIG. 33
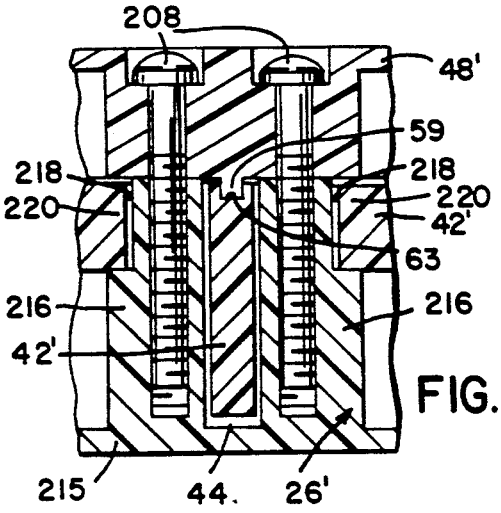
FIG. 36
FIG. 37
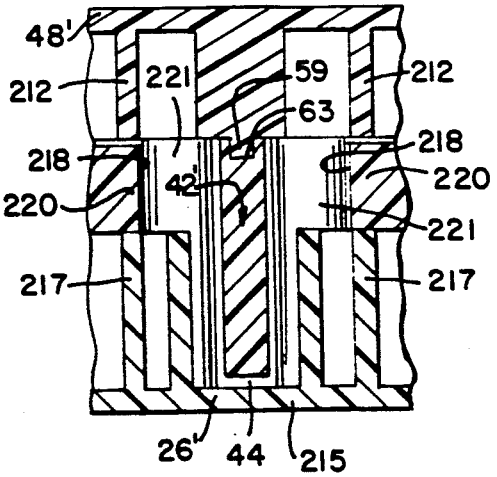

ELECTRIC SWITCH

FIELD OF INVENTION

This invention relates to electric switches, and in particular to electric switches for switching individual phases of multi-phase AC electric power.

BACKGROUND OF THE INVENTION

Universal fuse switches, like the one depicted in U.S. Pat. No. 4,748,431, are well known. These switches provide a means for contemporaneously opening and closing a set of circuits. They are also known to actuate auxiliary switches.

The requirements of industrialized switches have resulted in complex switching mechanisms and associated assembly techniques. Industrial switches are used in harsh environments where they are subjected to vigorous shock and vibration. They must be extremely reliable, structurally sound, and relatively inexpensive to manufacture. Moreover, it is desirable for the switches to provide a clear external indication of the state of the switch.

SUMMARY OF THE INVENTION

The present invention is an electric switch wherein electrical contacts are made in a vertical plane. Specifically, the switch has a drive mechanism housing wherein a drive mechanism is located. A lower contact housing is fastened vertically atop the drive mechanism housing. At least one pair of fixed terminals are located in the lower contact housing. Each fixed terminal has an ear extending upward in a vertical axial plane. An upper contact housing is fastened vertically atop the lower contact housing and a conducting device is fastened vertically atop the upper contact housing.

The conducting device has a pair of ears for the associated pair of fixed terminal ears. The ears on the conducting device extend downward in the vertical axial plane through the top of the upper contact housing. The conducting device can either employ a fuse carrier or a shorting circuit.

An axially translatable contact carrier is located between the lower and the upper contact housings. A pair of moving contacts are mounted on the contact carrier in the vertical axial plane to engage and disengage with the ears on the fixed terminals and the ears on the conducting device.

A drive mechanism is located in the drive mechanism housing for driving the axially translatable contact carrier. When the moving contacts are engaged, the switch allows electric power to flow from the line-side terminal to the load-side terminal. When the moving contacts are disengaged, the switch electric power cannot flow through the switch.

An object of the present invention is to allow the switch to be assembled in a generally vertical manner and thus ease assembly. The present invention accomplishes this object by designing the switch with a drive mechanism housing on the bottom in which the drive mechanism is mounted, placing the lower contact housing above the drive mechanism housing, mounting the fixed terminals in the lower contact housing in a vertical plane, placing the contact carrier above the lower contact housing, placing an upper contact housing above the lower contact housing thus enclosing the contact carrier, and placing the conducting device above the upper contact housing with its terminals also in a vertical plane.

Another object of the present invention is to design a switch that maintains integrity when vibrated vigorously. Since the moving contacts engage with the fixed terminals and the ears of the conducting device in a vertical plane, the switch has sufficient tolerance to accommodate aberrations caused by vibration.

An auxiliary switch may be mounted to the switch by a mounting bracket. The mounting bracket of the present invention has at least one clip for securing the bracket to the switch. The clip has a nose which keeps the clip from moving towards the auxiliary switch mounting bracket when an auxiliary switch is fastened to the bracket. The clip therefore remains secure in the switch even when the switch is vibrated vigorously.

Another object of the present invention is to provide a clear external indication of whether the switch is "on" or "off". The switch can accomplish this purpose by employing an on/off indicator wherein an "on" indicator is on a portion of the lower contact housing that is displayed when the contact carrier is in an "on" position and hidden when the contact carrier in an "off" position.

The foregoing objects and advantages of the invention will appear from the following description. In the description, references are made to the accompanying drawings which form a part hereof and in which a preferred embodiment of the invention is shown by way of illustration. Such embodiment does not necessarily represent the full scope of the invention.

BRIEF DESCRIPTION OF THE DRAWINGS

FIG. 7 is a view similar to FIG. 6 but with a drive slide and drive cam of the driving mechanism removed;

FIG. 8 is a detail view showing portions of the driving mechanism shown in FIG. 7;

FIG. 9 is a sectional view taken along line 9—9 of FIG. 8;

FIG. 10 is a sectional view taken along the line 10—10 of FIG. 8;

FIG. 11 is a top plan view showing a coupling for the driving mechanism;

FIG. 12 is a side elevation view showing the coupling of FIG. 11;

FIG. 13 is an elevation view of the coupling of FIG. 11 as viewed from line 13—13 of FIG. 11;

FIG. 14 is a top plan view of a spring compression lever for the driving mechanism;

FIG. 15 is a sectional view of the spring compression lever of FIG. 14 taken along the plane of the line 15—15 of FIG. 14;

FIG. 16 is a bottom plan view showing the spring compression lever of FIG. 14;

FIG. 17 is a top plan view of a spring guide for the driving mechanism;

FIG. 18 is a side elevation view of the spring guide of FIG. 17;

FIG. 19 is a front end elevation view of the spring guide of FIG. 17;

FIG. 20 is a rear end elevation view of the spring guide of FIG. 17;

FIG. 21 is a view similar to FIG. 7 but showing an auxiliary switching mechanism mounted at the front end of the switch;

FIG. 22 is a sectional view taken along line 22—22 of FIG. 21;

FIG. 23 is a front elevation view of an auxiliary cam for the driving mechanism;

FIG. 24 is a sectional view of the auxiliary cam as viewed from the line 24—24 of FIG. 23;

FIG. 25 is a bottom plan view of the auxiliary cam of FIG. 23;

FIG. 26 is a front elevation view showing an auxiliary switch mounting bracket for the switch with a portion of the bracket broken away;

FIG. 27 is a top plan view of the auxiliary switch mounting bracket of FIG. 26;

FIG. 28 is a rear plan view of the auxiliary switch mounting bracket of FIG. 26;

FIG. 29 is a sectional view taken along line 29—29 of FIG. 28;

FIG. 30 is a top plan view of a lower contact housing for the switch with a contact carrier shown in phantom;

FIG. 31 is a top plan view of a contact carrier for the switch;

FIG. 32 is a top assembled view of an upper contact housing, a lower contact housing and a contact carrier for an alternative embodiment of a switch of the invention;

FIG. 33 is a top plan view of a contact carrier for use in the embodiment in FIG. 32;

FIG. 36 is a cross-sectional view of the assembly shown in FIG. 32 taken along line 36—36 in FIG. 32; and FIG. 37 is a cross-sectional view of the assembly shown in FIG. 32 taken along line 37—37 in FIG. 32.

DESCRIPTION OF THE PREFERRED EMBODIMENT

Figure 1:
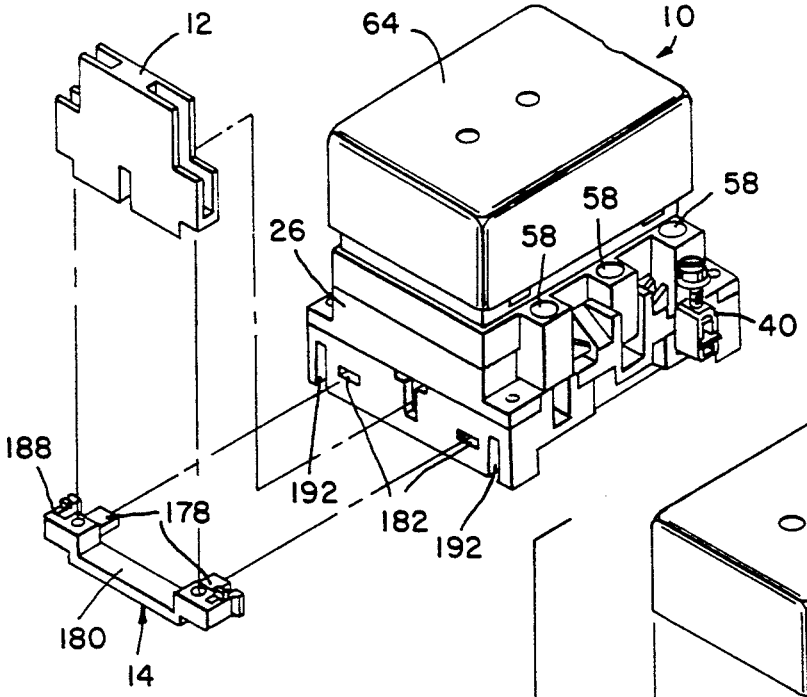
FIG. 1 is a perspective view of an assembled switch of the present invention with an auxiliary switch and mounting bracket exploded away from the switch.

An electric switch 10 of the present invention is shown in FIG. 1. The conducting elements of the electric switch 10 are made from conductive metal (e.g. copper) and the other elements are generally made from molded, thermo-setting plastic. Some elements, as identified in this description, are made from other materials.

As shown in FIG. 1, an auxiliary switch 12 can be mounted to the electric switch 10 by an auxiliary switch mounting bracket 14. The auxiliary switch mounting bracket 14 is flexible and made from molded, thermoplastic..

Figure 2A:
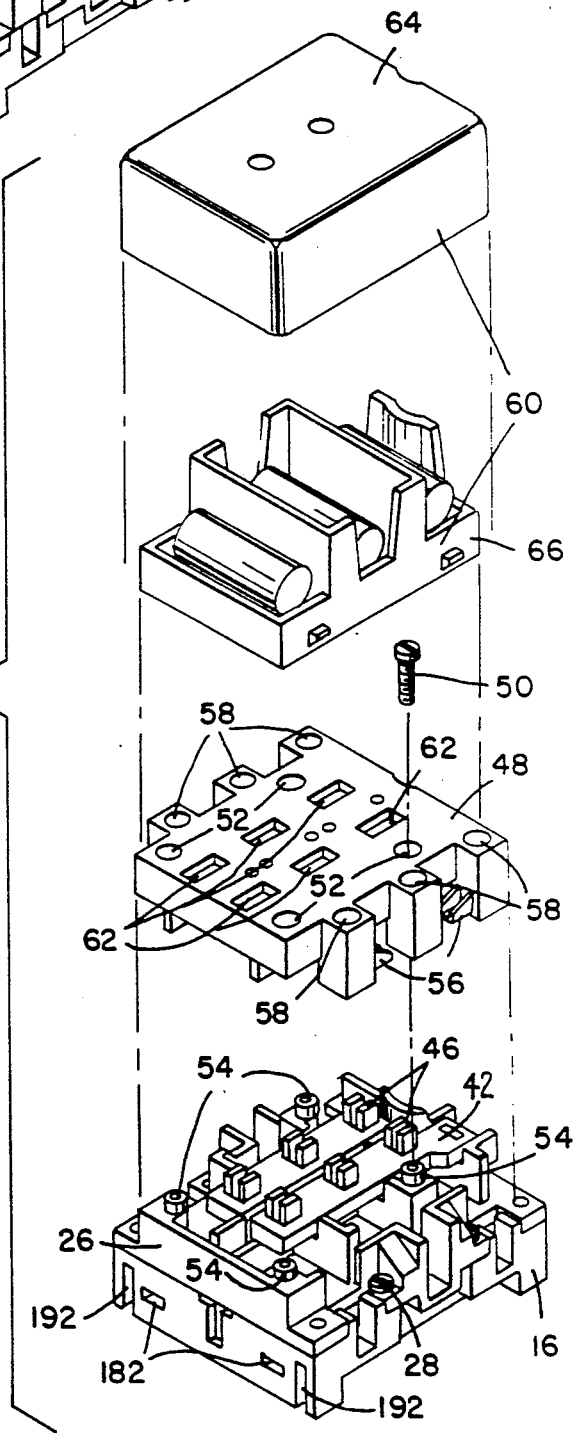
FIG. 2A is an exploded perspective view of the upper portion of the switch of the present invention.
Figure 2B:
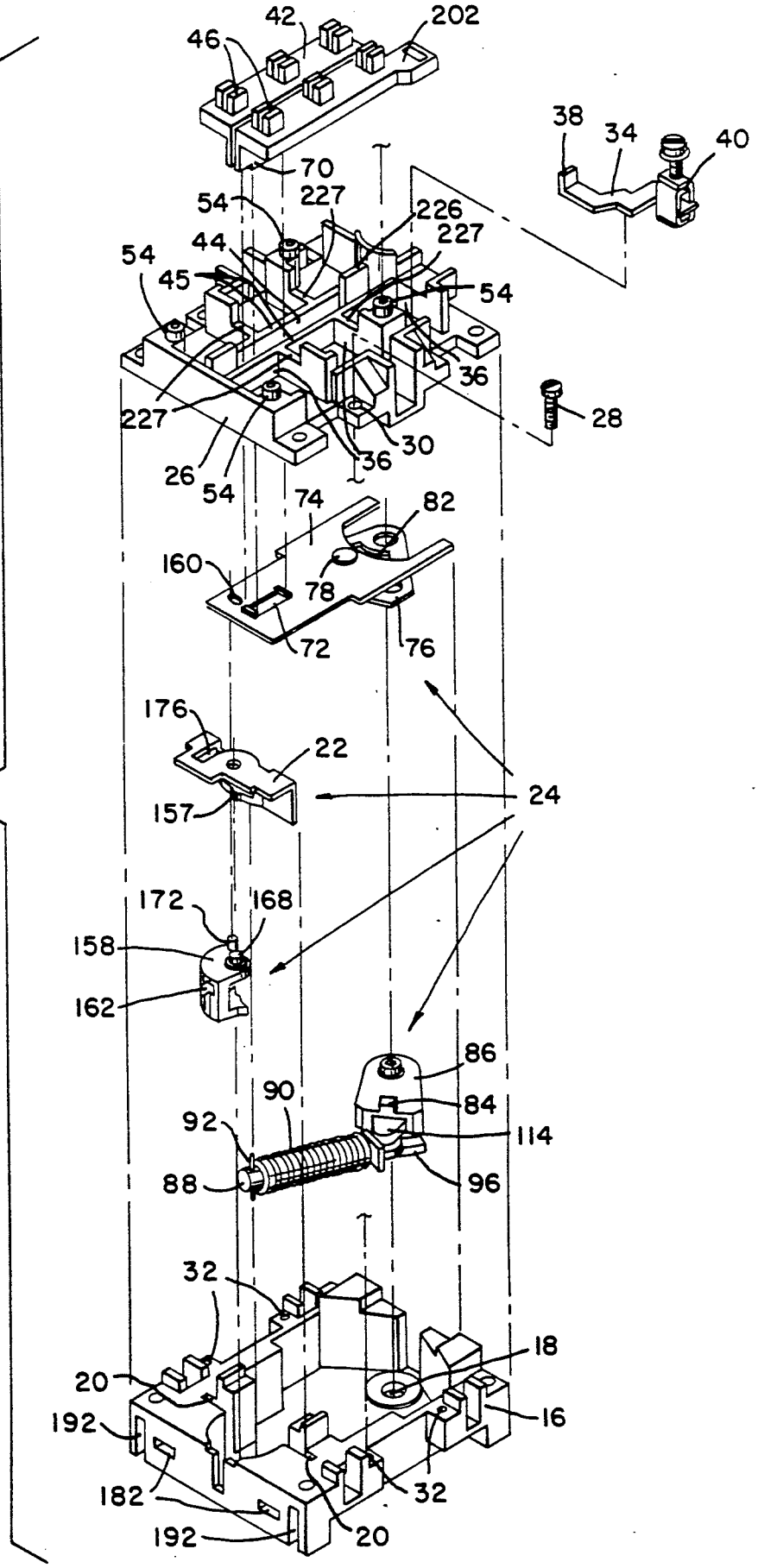
FIG. 2B is an exploded perspective view of the lower portion of the switch of the present invention.
Figure 3:
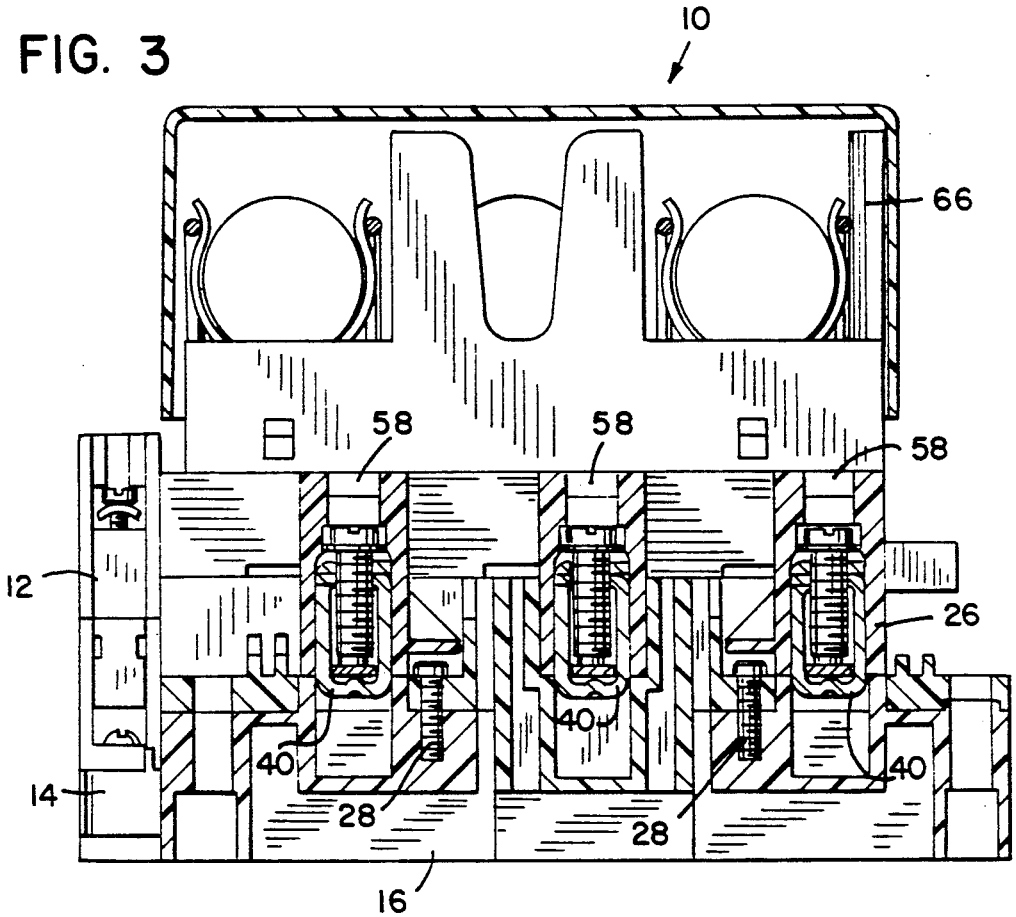
FIG. 3 is a side view of the switch with portions of the switch casing broken away.

Referring to FIGS. 2A and 2B, the electric switch 10 is assembled vertically from the bottom upwards. A drive mechanism housing 16 serves as a base for the switch 10. The floor of the drive mechanism housing 16 has a pivot hole 18 formed towards the butt end of the housing 16. The housing 16 has a slot 20 for receiving a spring support 22 towards the nose end of the housing 16. When assembled, the components of the drive mechanism 24 are located in the drive mechanism housing 16, as described below.

A lower contact housing 26 is fastened on top of the drive mechanism housing 16 by four screws 28 extending through holes 30 in the lower contact housing 26 and secured in holes 32 in the drive mechanism housing 16. Three pairs of opposed fixed terminals 34 are mounted on the lower contact housing 26 within separate chambers 36. Of each pair of opposed terminals 34, one terminal is on the load side of the switch 10 and the other terminal is on the line side. Each fixed terminal 34 has an ear 38 which extends vertically when the fixed terminal 34 is mounted in a chamber 36 of the lower contact housing 26. Wire clamps 40 are used to attach wires to the fixed terminals 34.

A contact carrier 42 is placed in an axial groove 44 in the lower contact housing 26. Referring to FIG. 2B, the axial groove 44 is comprised of two axial walls 45. Each axial wall 45 is also the inner most wall for three associated chambers 36 in the lower contact housing 26. The axial walls 45 of the axial groove 44 and the other walls of the chambers 36 support the contact carrier 42. The axial walls 45 of the axial groove 44 also provide lateral support for the contact carrier 42. The length of the axial groove 44 is greater than the length of the contact carrier 42 by approximately one-half of the axial length of the chambers 36. The contact carrier 42 is thus allowed to slide within the axial groove 44.

The contact carrier 42 carries three pairs of moving contacts 46. The moving contacts 46 are orientated vertically such that they engage the vertical ears 38 of the fixed terminals 34 when the contact carrier 42 is slid into an "on" position and disengage the ears 38 in an "off" position.

Referring to FIG. 31, contact springs 206 secure the moving contacts 46 on the contact carrier 42. As the moving contacts 46 engage the vertical ears 38 of the fixed terminals 34, each pair of moving contacts 46 is pushed apart against spring tension. In this manner, proper electrical contact is assured.

Referring again to FIGS. 2A and 2B, the upper contact housing 48 is mounted on top of the lower contact housing 26 by four screws 50 which extend through holes 52 in the upper contact housing 48 and are secured in holes 54 in the lower contact housing 26. The upper contact housing 48 has four screw covers 56 which cover the screws 28 used to fasten the lower contact housing 26 to the drive mechanism housing 16. The screw covers 56 keep the screws 28 from being tampered with or unscrewed inadvertently.

Three pairs of holes 58 in the upper contact housing 48 provide screw driver access to the screws of the wire clamps 40.

The upper contact housing 48 has an axial ridge 59 on its bottom surface which is received by an axial groove 63 on the contact carrier 42 (FIG. 31). The cooperation between the ridge 59 and the groove 63 stabilizes the contact carrier 42 while allowing the contact carrier 42 to translate axially.

The cooperation between the ridge 59 and the groove 63 further serves to close free space paths between opposing fixed terminals 34 in the lower contact housing 26 when the switch 10 is in the "off" position. The butress 226 in the lower contact housing 26 also helps close free space paths when the contact carrier 42 is in the "off" position because in the "off" position the contact carrier 42 abuts against the butress 226.

Referring to FIG. 31, the contact carrier 42 has horizontal indentions 229 on its top and bottom surfaces. The indentions 229 are separated by horizontal ribs 228 which are the same height as the top and bottom surfaces of the contact carrier 42. Referring again to FIG. 2B, the width of the indentions 229 on the contact carrier 42 is less than the width of the walls 227 of the lower contact housing 26. In this manner, each chamber 36 in the lower contact housing is sealed from adjacent chambers 36.

A conducting device 60 is mounted on top of the upper contact housing 48. As shown in FIG. 2A, the conducting device can either be a shorting circuit 64 or a fuse carrier 66. When the conducting device 60 is mounted on the upper contact housing 48, the conducting device 60 covers the screw holes 52 in the upper contact housing 48, thus preventing the screws 50 from being unscrewed inadvertently.

Figure 4:
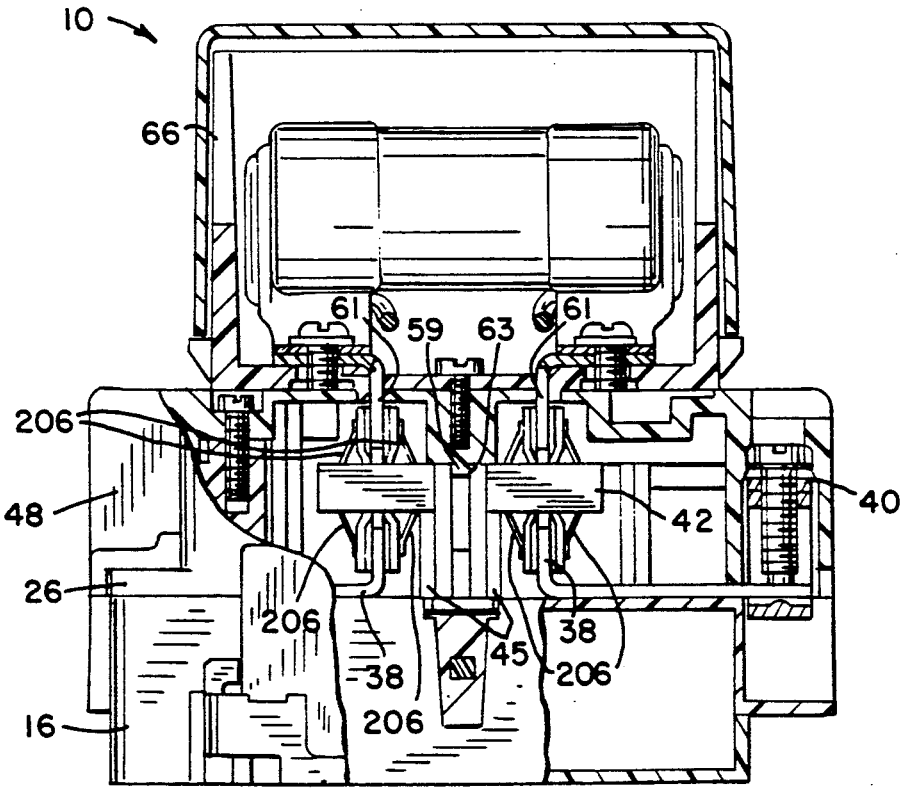
FIG. 4 is an end view of the switch with portions of the switch casing broken away.

The conducting device 60 has three pairs of opposed contacts 61 (see FIGS. 4 and 5), with one contact of each pair on the load side of the switch and the other contact of each pair on the line side. The contacts for the conducting device 60 extend vertically downward through the openings 62 in the upper contact housing 48 when the conducting device 60 is mounted. Each contact 61 is substantially aligned vertically with a corresponding ear 38 on a fixed terminal 34. Referring to FIG. 4, the contact carrier 42 is in an "on" position 46, with the contacts 61 on the conducting device 60 engaged in the top portion of the moving contacts 46 and the ears 38 of the fixed terminals 34 engaged in the lower portion of the moving contacts 46. When the moving contacts 46 engage with the contacts 61 of the conducting device 60 and the ears 38 of the fixed terminals 34, the contact springs 206 assure proper electrical contact as described above.

When the contact carrier 42 is slid to the "on" position, electric power from a wire attached to a fixed terminal 34 by the wire clamps 40 is transmitted through the ear 38 of the fixed terminal 34, the moving contact 46 and a corresponding contact 61 on the conducting device 60. Electric power is then transmitted through the conducting device 60 to the load-side contact 61 of the conducting device 60, the corresponding moving contact 46, the ear 38 on the associated fixed terminal 34, and finally to the load-side wire.

If the conducting device 60 is a shorting circuit 64, electricity flows directly from the line-side contact 61 to the load-side contact 61 through a conductive piece of metal. In the preferred embodiment, each pair of contacts 61 and the conductive shorting circuit between the contacts 61 are made from a single piece of conductive metal. Referring to FIG. 4, if the conducting device 60 is a fuse carrier 66, electricity must flow through a fuse to be transmitted from a line-side contact 61 to a load-side contact 61.

Figure 5:
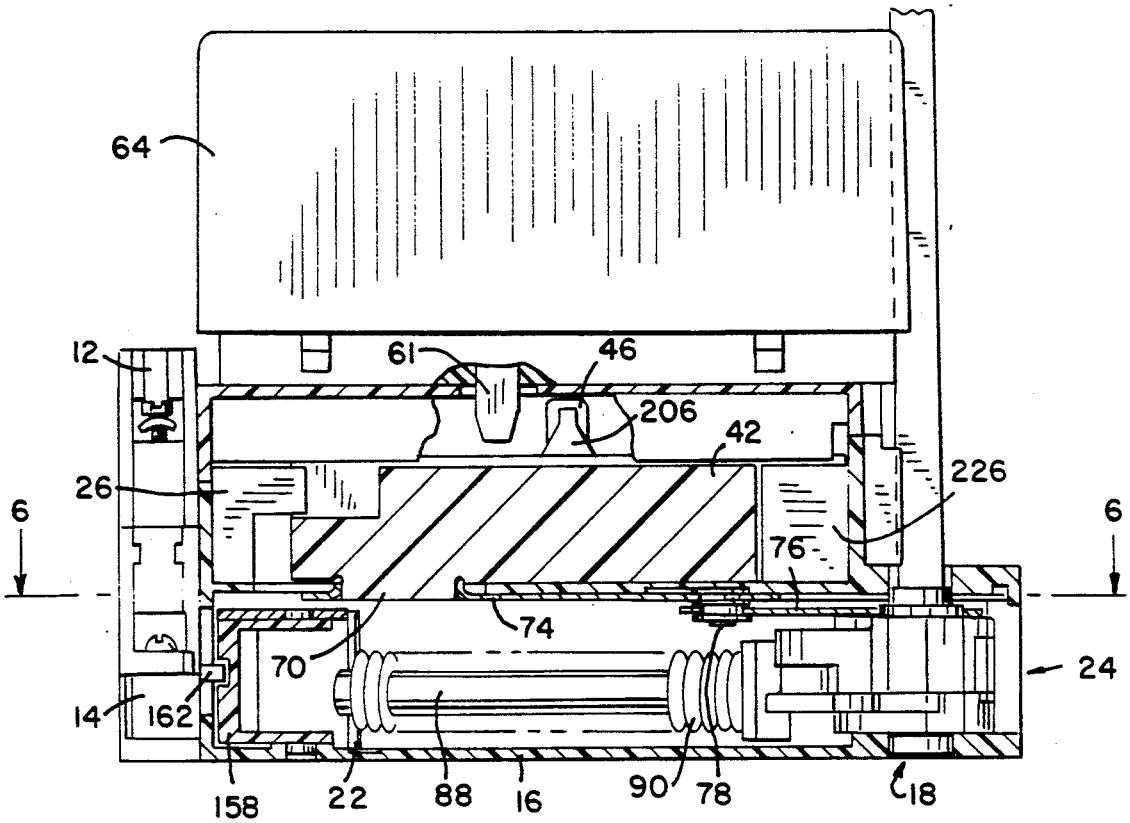
FIG. 5 is another side view of the present switch with portions of the switch casing broken away.

Referring to FIG. 5, the contact carrier 42 is in the "off" position. When the contact carrier 42 is slid to the "off" position, the moving contacts 46 do not contact the fixed teerminals 34 or the contacts 61 on the conducting device 60. Electricity, therefore, cannot be transferred from the line-side terminal to the load-side terminal when the contact carrier 42 is in the "off" position.

Still referring to FIG. 5, the contact carrier 42 has a boss 70 that is received by an opening 72 in a drive slide 74. The drive slide 74 is made from sheet metal. The contact carrier 42 is slid between the "on" and "off" positions as the drive slide 74 is slid back and forth by the remainder of the drive mechanism 24.

Figure 6:
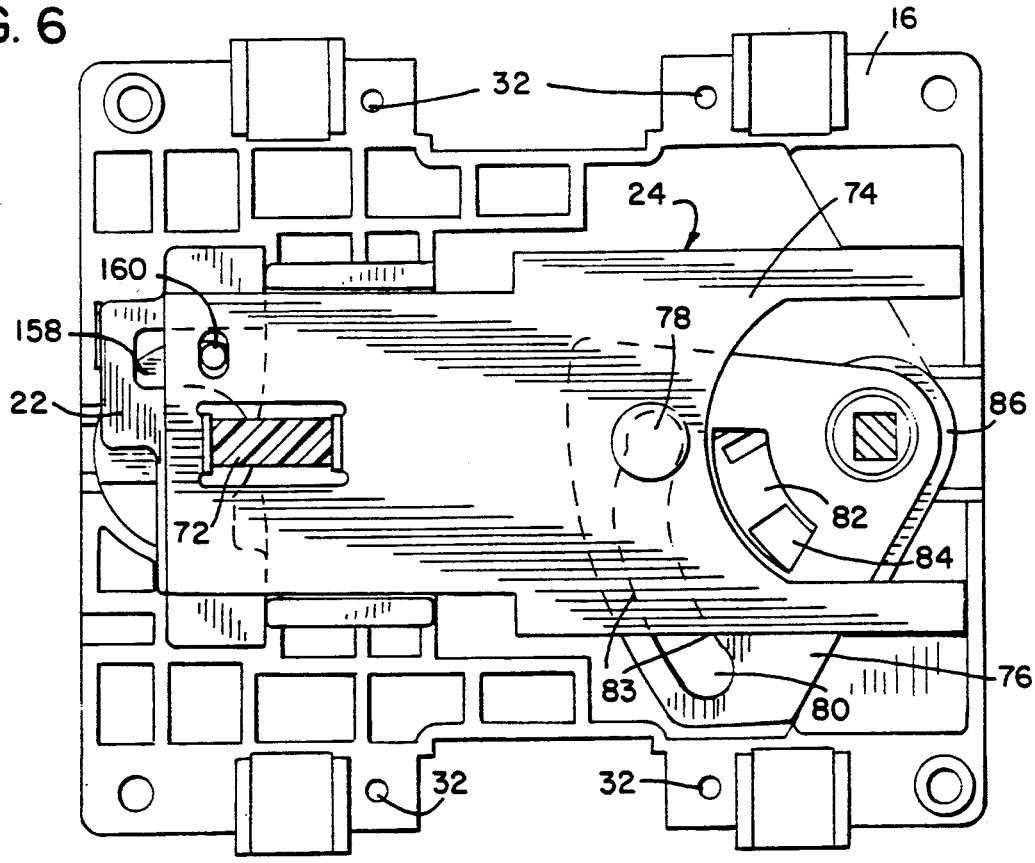
FIG. 6 is a sectional view of a driving mechanism for the switch as viewed from the plane of 6—6 in FIG. 5.

Referring to FIG. 6, the drive slide 74 slides toward the "on" position as the drive cam 76 rotates clockwise as viewed in FIGS. 6 and 7. The drive slide 74 is coupled to a drive cam 76 by a rivet 78 which is slidable in a cam transmission slot 80 of the cam 76. The cam transmission slot 80 is shaped such that the drive slide 74 does not move as the drive cam 76 is rotated for the first 4 degrees in the clockwise direction. The drive slide 74 then slides abruptly for the next 50 degrees that the drive cam 76 is rotated. The cam transmission slot 80 is shaped such that the drive slide 74 moves relative to the rotation of the drive cam 76 when the drive cam 76 is rotated in either direction. The moving contacts 46 are therefore engaged in the "on" position abruptly with clockwise drive cam 76 rotation and disengaged into the "off" position with counter-clockwise drive cam 76 rotation at a consistent rate.

The drive cam 76 is rotary driven by a boss 84 on a spring compression lever 86 that presses against the drive cam 76 through a cam driving slot 82. The boss 84 on the spring compression lever fits in the cam driving slot 82 with significant room to spare in the circumferential direction. The spring compression lever 86 must therefore rotate a certain distance before the boss 84 presses against the drive cam 76.

Referring to FIG. 7, the drive mechanism 24 is shown in an "off" position and the phantom drive mechanism 86' is in an "on" position. Because the drive mechanism 24 operates through over-center shifting with lost-motion, the drive mechanism 24 can rest in only a completely "on" position or a completely "off" position. The over-center shifting means of the present embodiment is described below. Over-center shifting relates generally to shifting means wherein a spring or the like forces the switch to a completely "on", or completely "off", state when the switch is shifted just past the shifting mid-point. The present embodiment employs several lost-motion means which are described herein. In general, lost-motion means refer to cooperation between elements wherein the parts of the switching apparatus move while other parts remain stationary or nearly stationary. As described below, lost-motion means can be useful for facilitating the operation of over-center shifting mechanisms.

Referring to FIG. 8, the drive mechanism 24 has several components including: a spring guide 88, a drive spring 90, a roll pin 92 that secures the drive spring 90 on the spring guide 88, a spring compression lever 86, a handle return spring 94 inserted within an internal slit 126 in the spring compression lever 86, and a coupling 96 which receives a rotary operating shaft (not shown) for turning the switch "on" and "off".

The coupling 96 is shown in detail in FIGS. 11–13. The coupling 96 has a base 98 with a stepped edge 100, a cylindrical shaft 102 perpendicular to the base 98, and a pad 104 and a projection 106 mounted on top of the base 98. The cylindrical shaft 102 extends above and below the base 98. The portion of the cylindrical shaft 102 that extends below the base 98 is for mounting the coupling 96 in the pivot hole 18 in the drive mechanism housing 16 (see FIG. 2B). As will be described later, the spring compression lever 86 and the drive cam 76 are co-axially mounted on top of the coupling 96 by being journaled on the portion of the cylindrical shaft 102 which is above the base 98 of the coupling 96, and the top of the shaft 102 is journaled in hole 103 (see FIG. 30) in the lower contact housing 26. Referring to FIG. 11, the cylindrical shaft 102 of the coupling 96 has an axial, rectangular hole 108 for receiving an operating shaft (not shown) to turn the switch 10 "on" and "off". Near the base 98 of the coupling 96, the cylindrical shaft 102 has a horizontal hole 110 for receiving a hook pin (not shown) which secures the operating shaft axially in hole 108.

Referring to FIGS. 14–16, the spring compression lever 86 has a cylindrical hole 112 for mounting the lever 86 on the coupling 96. The boss 84 on the spring compression lever 86 extends from the top surface of the lever 86 and drives the drive cam 76 in both the clockwise and counter-clockwise rotary directions. The spring compression lever 86 has a bearing 114 for receiving a journal 116 on a spring guide 88 (see FIGS. 17 and 18). The bearing 114 extends radially from the peripheral surface 120 of the spring compression lever 86 to allow the spring guide 88 adequate clearance during rotation. The receiving bore 115 of the bearing 114 is generally shaped to receive the cylindrical-shaped journal 116 on the spring guide 88. The bearing 114 has a buttress 122 which is adjacent to the circumferential surface 120 of the lever 86 and extends to the lower surface 121 of the lever 86. The buttress 122 of the bearing 114 supports the pressure exerted by the journal 116 of the spring guide 88 along the center line of the spring guide 88.

Referring to FIG. 16, the bottom of the spring compression lever 86 has a chamber 124, which is located between the axial hole 112 in the lever 86 and the surface 120 of the lever 86. The spring compression lever 86 also has an internal slit 126 which extends around the axial hole 112 near the periphery of the lever 86, except on the side of the lever 86 where the surface 120 is located. The internal slit 126 is a thin channel on the right side 130 of the spring compression lever 86 and continues as a thin channel to the left side 128 of the lever 86. As the internal slit 126 extends along the left side 128 of the lever 86, it widens to form a generally V-shaped void. A notch 132 through the wall of the spring compression lever 86 exposes the internal slit 126 at the beginning of the left side 128 of the spring compression lever 86. Referring again to FIG. 8, a handle return spring 94 is placed in the internal slit 126. A portion of the handle return spring 94 can be seen through the notch 132.

Referring to FIGS. 17 through 20, the spring guide 88 is generally a rod with a slot 136 through its nose end, a cylindrical journal 116 located at the butt end of the rod and perpendicular to the axis of the spring guide 88, a backboard 138 located between the slot 136 and the journal 116, and a lip 140 which abuts the journal 116 and extends perpendicular from the journal 116.

A support 142 is located between the journal 116 and the backboard 138. The support 142 provides additional strength for both the journal 116 and the backboard 138. The support 142 also facilitates the proper alignment of the spring guide 88 and the bearing 114 of the spring compression lever 86. The height of the support 142 is the distance 144 (FIG. 15) between the lower surface of the buttress 122 of the bearing 114 on the spring compression lever 86 and the lower surface of the nose 146 of the bearing 114. With this design, the support 142 abuts the nose 146 of the bearing 114 when the lip 140 abuts the buttress 122 of the bearing 114, thus facilitating proper alignment.

The lip 140 extends circumferentially about the journal 116 away from the spring guide 88. Referring to FIG. 10, the lip 140 of the spring guide 88 fits between the lower surface of the buttress 122 of the bearing 114 on the spring compression lever 86 and the step 148 located on the stepped edge 100 of the coupling 96 when the spring compression lever 86 is mounted on top of the coupling 96 so that the journal 116 resides in the bearing 114.

Referring to FIG. 9, which is a sectional view of the spring compression lever 86 mounted on top of the coupling 96, the pad 104 on the coupling 96 resides in the chamber 124 of the spring compression lever 86 and the projection 106 on the coupling 96 resides in the notch 132 of the spring compression lever 86. As the operating shaft rotates the coupling 96 in a clockwise direction, the pad 104 moves across the chamber 124 and the projection 106 compresses the handle return spring 94. The dimensions of the parts on the coupling 96 and the spring compression lever 86 are such that the pad 104 pushes against the wall of the chamber 124 before the handle return spring 134 reaches the inner wall of the internal slit 126. With this design, the pad 104 receives virtually all of the stress on the coupling 96 when the coupling 96 rotates the spring compression lever 86. The projection 106 on the coupling 96 does not push against the spring compression lever 86, but merely compresses the handle return spring 94.

Referring to FIGS. 7, 21, and 22, a spring support 22 is mounted in the drive mechanism housing 16. The spring support is made from punched sheet metal. The spring support 22 has a vertical face and horizontal face. On the vertical face of the spring support 22, the spring support has a vertical depression 156 for receiving the roll pin 92. The cooperation between the depression 156 and the roll pin 92 acts as a hinge for allowing the spring guide 88 to pivot about the roll pin 92. Referring to FIG. 7, as the spring compression lever 86 rotates clockwise, the spring guide 88 is pushed through a hole 157 (FIG. 22) in the spring support 22 against the pressure of the drive spring 90. As the spring guide 88 pushes through the hole 157 in the spring support 22 and rotates, the drive spring 90 is compressed between the roll pin 92 and the backboard 138 of the spring guide 88. As soon as the spring guide 88 rotates a couple of degrees past center rotation, the drive spring 90 pushes against the backboard 138 of the spring guide 88 to drive the entire driving mechanism 24 to a completely "on" or "off" position. This sort of switching action is referred to in the art as over-center shifting.

In order to prevent an operator from holding the switch at the center of rotation and in a position that is not completely "on" or "off", two lost-motion mechanisms are embodied in the switch 10. One such mechanism is that associated with the handle return spring 94. As described above, the projection 106 on the coupling 96 compresses the handle return spring 94 when the coupling 96 is rotated clockwise to turn the spring compression lever 86. As soon as the spring guide 88 passes center rotation, the pad 104 on the coupling 96 is relieved of pressure and the handle return spring 94 extends to push the spring compression lever 86 into alignment with the coupling 96. In this manner, the spring compression lever 86 is rotated from a position barely past center rotation to a position 17 degrees past center rotation. Since the drive spring 90 is unloading at the same time that the handle return spring 94 is aligning the spring compression lever 86 to the coupling 96, the entire drive mechanism 24 gains momentum thus making it difficult for an operator to hold the switch in a partially "on" position.

When the drive mechanism is turned to an "off" position, by rotating it counter-clockwise, the lost-motion due to the cooperation between the pad 104 and the chamber 124 again works to prevent the operator from holding the switch in a partially "on" position, although not in the same manner. When rotating the coupling 96 in a counter-clockwise direction, the spring compression lever 86 remains aligned with the coupling 96. As the spring guide 88 passes center rotation, the drive spring 90 drives the spring compression lever 86 ahead of the coupling 96 (against the pressure of the handle return spring 94) once again making it difficult for an operator to hold the switch in a partially "on" position.

Referring again to FIG. 6, the other significant lost-motion means is associated with the cam transmission slot 80. When the spring compression lever 86 rotates clockwise and pushes against the drive cam 76 through the cam driving slot 82, the drive cam 76 begins to rotate for a few degrees without sliding the drive slide 74 because the radius of the cam surface 83 of the slot 82 starts as being constant. As the cam rotates farther, the drive slide 74 translates to an "on" position abruptly because of a rapidly increasing radius of the cam surface 83 of the slot 82. When the drive cam 76 is rotated counter-clockwise to put the switch in an "off" position, the cam transmission slot 80 does not have a similar lost-motion mechanism. Rather, the radius of the cam surface 83 increases gradually at a constant rate. The shape of the cam transmission slot 80 therefore promotes abrupt closing of the switch and gradual opening of the switch 10.

Referring again to FIGS. 21 and 22, the spring support 22 also journals the top end of an auxiliary cam 158. The auxiliary cam 158 is engaged by a hole 160 in the drive slide 74. An actuator 162 of an auxiliary switch 12 can be driven by the auxiliary cam 158 by means of cam transmission. Referring specifically to FIGS. 23 through 25, the auxiliary cam 158 is generally wedge-shaped with a cam groove 164 on an outer cylindrical surface 166. The auxiliary cam 158 has an upper post 168 journaled in the spring support 22 and a lower post 170 journaled to the drive mechanism housing 16 for mounting the cam about a vertical axis of rotation through the posts 168 and 170. A cam boss 172 is located on the upper surface of the cam 158, which extends farther circumferentially than the lower surface of the cam 158. When the switch 10 is assembled, the cam boss 172 is received in the elongated hole 160 (FIG. 6) in the drive slide 74. As the switch 10 is turned "on", the drive slide 74 not only translates the contact carrier 42 into an "on" position, but also rotates the auxiliary cam 158 via the cam boss 172 so that the actuator 162 on the auxiliary switch 12 is lowered as the auxiliary cam 158 rotates. Referring to FIG. 2B, the hole 160 in the drive slide is not circular, but rather oblong in order to allow the cam boss 172 to translate sideways relative to the hole 160 as the drive slide 74 pushes the cam boss 172 primarily towards the nose of the switch 10. The shape of the hole 160 is necessary because the cam boss 172 does not move linearly, but rather through an arc. Referring to FIG. 21, the spring support 22 has an opening 176 to allow ample clearance for the cam boss 72 as it translates.

Referring to FIG. 22, the auxiliary cam 158 is hollow (see reference numeral 179). It is necessary for the auxiliary cam 158 to be hollow because the spring guide 88 reciprocates into the volume 179 within the auxiliary cam 158 when the switch 10 is being opened and closed.

Referring to FIGS. 1 and 26 through 29, the auxiliary switch 12 can be mounted to the switch 10 using an auxiliary switch mounting bracket 14. As shown in FIG. 1, the auxiliary switch mounting bracket 14 has two feet 178 that extend horizontally from the bridge 180 of the bracket 14. Each of the feet 178 is received by a similarly shaped horizontal opening 182 in the side of the drive mechanism housing 16 (FIGS. 1, 2A and 2B). The bridge 180 of the auxiliary switch mounting bracket 14 is in a horizontal plane lower than the feet 178. The bracket 14 also has two fastening pads 196 for fastening the auxiliary switch 12 to the bracket 14. Each fastening pad 196 is aligned with an associated foot 178 on a plane above the bridge 180. Walls 184 extend between the bridge 180 and the fastening pad 196. The auxiliary switch 12 is supported by the bridge 180 and the walls 184 and screwed onto the bracket 14 through screw holes 186 in the fastening pad 196 as shown in FIGS. 27 and 29. The bracket 14 may be constructed with metal threaded inserts located in the screw holes 186 to receive the screws that fasten the auxiliary switch 12 onto the bracket 14.

In order to secure the bracket 14 on the electric switch 10, the auxiliary switch mounting bracket 14 has two clips 188, one located outside of each foot 178 on the bracket 14. As shown in FIG. 27, the clips are parallel to the feet 178 and a space 189 is between each clip and the corresponding foot. The space 189 allows the clip to be squeezed towards the foot 178. A catch 190 is located on the end of each clip 188. Referring again to FIG. 1, as the bracket 14 is mounted onto the switch 10 and the feet 178 are mounted into the horizontal openings 182, the clips 188 move into clip ports 192 where the catches 190 on the clips 188 catch on vertical ledges (not shown) in the clip ports 192. To remove the bracket 14 from the switch 10, the clips 188 are squeezed to release the catches 190. Once the bracket 14 is mounted on the switch 10, the auxiliary switch can be mounted on top of the bracket 14.

Referring again to FIGS. 26 through 29, each clip also has a nose 194. Each nose 194 extends from the main body of the clip 188 inward on a plane above the fastening pad 196. With this design, the clips 188 can be squeezed when an auxiliary switch 12 is not fastened to the bracket 14, but the clips 188 cannot squeeze inward when an auxiliary switch 12 is fastened to the bracket 14 because a switch 12 fastened on the bracket 14 interferes with the noses 194 on the clips 188. The catches 190 on the clips 188 therefore remain secure in the clip ports 192 even if the switch is vibrated vigorously.

Referring to FIGS. 30 and 31, the lower contact housing 26 has a crib 198 located near the operating shaft (not shown) for receiving an "on" indicator 200. The contact carrier 42 has a mask 202 extending from the primary plane of the contact carrier. The top surface of the mask 202 receives an "off" indicator 204. When the contact carrier 42 is in an "off" position, the mask 202 covers the "on" indicator 200 located in the crib 198. As the contact carrier translates to an "on" position, the "on" indicator 200 is exposed to the operator and the "off" indicator 204 is hidden under the upper contact housing 48. With this design a switch operator is less likely to be confused as to whether the switch 10 is "on" or "off" because an operator can see only an "off" or an "on" indicator at any single point in time. Moreover, this indicator is less likely to fail because the mask 202 is an integral component of the contact carrier 42.

FIGS. 32 through 37 refer generally to alternative components of the switch 10 that can be used to assure that the upper contact housing 48 and the lower contact housing 26 are fastened securely around the contact carrier 42 even when there is a heavy electrical load. Under heavy electrical loads, the upper contact housing 48 and the lower contact housing 26 may tend to bow apart. The bowing can allow for free space to occur between opposing fixed terminals 34 of a single phase or between fixed terminals 34 of different phases. It is possible that arcing can occur between fixed terminals 34 when free space exists. Referring in particular to FIG. 32, bowing can be eliminated using screws 208 to secure the middle of the upper contact housing 48' to the middle of the lower contact housing 26'. The upper contact housing 48' shown in FIG. 32 corresponds to the upper contact housing 48 first identified in FIG. 2A, except for the alterations described herein to assure that bowing does not occur. Likewise, the lower contact housing 26' in FIG. 32 and the contact carrier 42' in FIG. 32 correspond to the lower contact housing 26 and the contact carrier 42 first shown in FIG. 2B.

Referring to FIG. 33, the contact carrier 42' for the alternative embodiment is generally the same as the contact carrier 42 first shown in FIG. 2B except the contact carrier 42' has two longitudinal elongated holes 218 near its center. The contact carrier 42' also has two additional surface ridges 220 that extend longitudinally along the contact carrier 42' with each ridge 220 being adjacent to an outer edge of a longitudinal hole 218.

Figure 34:
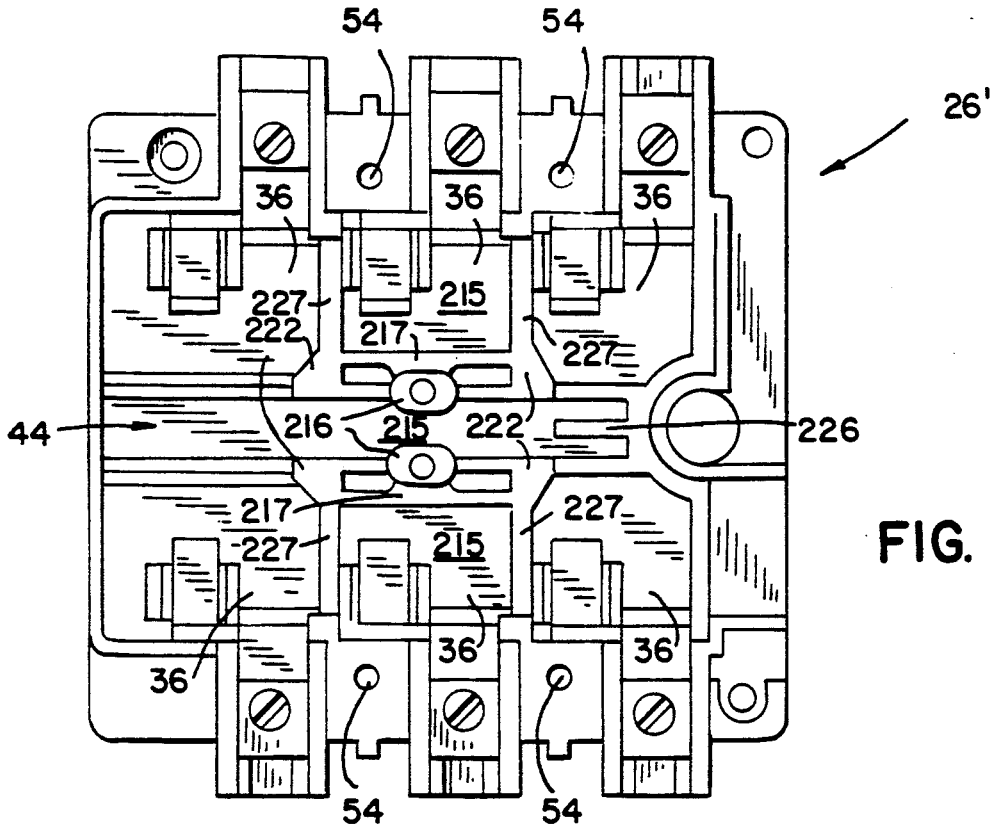
FIG. 34 is a top plan view of the lower contact housing shown in FIG. 32.

Referring to FIG. 34, the lower contact housing 26' has generally the same design as the contact carrier 26 first shown in FIG. 2B except it has two screw receiving pads 216 for receiving screws 208. The screw pads 216 extend upwards from the floor 215 of the lower contact housing to a height slightly above the top surface of the contact carrier 42' when the contact carrier is properly placed in the axial groove 44 and fit within the longitudinal holes 218 of the contact carrier 42'. The longitudinal holes 218 are longer than the screw receiving pads 216, thus enabling the contact carrier 42' to translate longitudinally along the axial groove 44. Since the screw receiving pads 216 extend to a height slightly above the top surface of the contact carrier 42', the contact carrier 42' is allowed to slide along the axial groove 44 without being pinched tightly by the upper 48' and lower 26' contact housings.

FIG. 36 is a cross-sectional view of the upper 48' and lower 26' contact housings assembled around the contact carrier 42' as taken along line 36—36 in FIG. 32. FIG. 36 shows clearly that the screws 208 fasten the upper contact housing 48' into abutment with the screw receiving pads 216 of the lower contact housing 26' and prevent the upper 48' and lower 26' contact housings from bowing apart.

Figure 35:
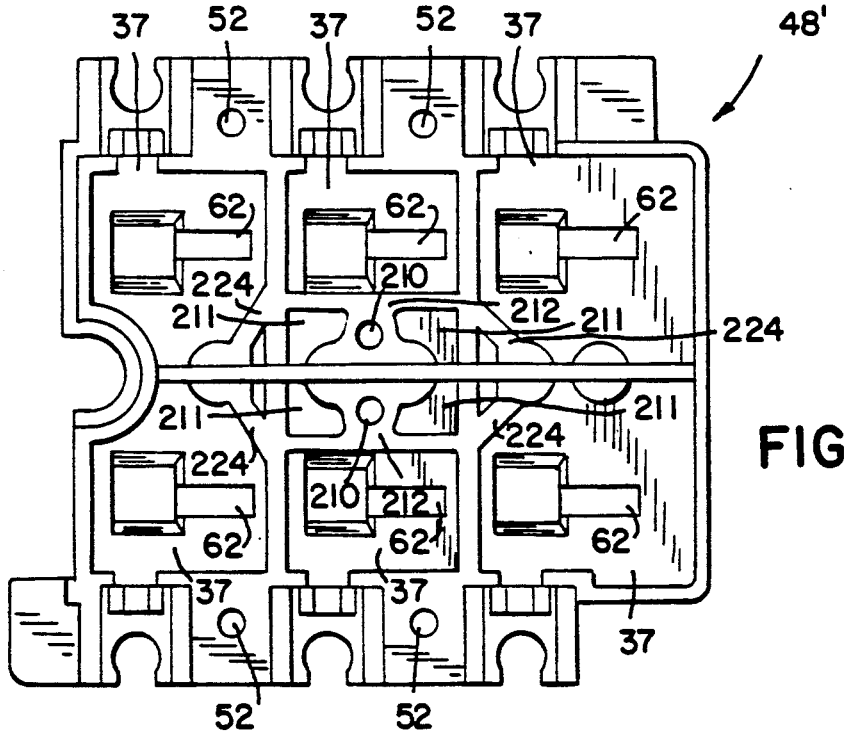
FIG. 35 is a bottom plan view of the upper contact housing shown in FIG. 32.

Referring to FIG. 37, a pair of isolation walls 217 in the lower contact housing 26' and a pair of isolation walls 212 in the upper contact housing 48' operate in conjunction with the surface ridge 220 on the contact carrier 42' to prevent arcing through free space 221 in the longitudinal holes 218 of the contact carrier 42'. The free space 221 in the longitudinal holes 218 occurs because the holes 218 are larger than the screw receiving pads 216. The lower isolation walls 217 extend upward from the floor 215 of the lower contact housing 26' to the height of the lower surface of the contact carrier 42' when the contact carrier is in place in the axial groove 44. Each of the two lower isolation walls 217 extends longitudinally across the corresponding chamber 36 in the lower contact housing 26' (see FIG. 34). Referring to FIG. 35, each of two upper isolation walls 212 are similarly constructed in the upper contact housing 48'. That is, each of the two upper isolation walls 212 extends downward from the ceiling 211 of the upper contact housing 48' to the position of the top surface of the contact carrier 42' when the contact carrier 42' is placed within the axial groove 44. The upper isolation walls 212 also run longitudinally in the corresponding chamber 37 in the upper contact housing 48'. Referring again to FIG. 37, each lower isolation wall 217 is aligned vertically with a corresponding surface ridge 220 on the contact carrier 42' and a corresponding upper isolation wall 212 in the upper contact housing 48'. These three components effectively form a barrier between the chambers 36 and 37 in the lower 26' and upper 48' contact housings and the free space around the screw pads 216. Depending on the size of the longitudinal holes 218 in the contact carrier 42', it may also be necessary to include molded plugs 222 (see FIG. 34) and 224 (see FIG. 35) to prevent gaps from occurring between the outer chambers 36 and 37 and the free space around the screw receiving pads 216. The plugs 222 in the lower contact housing 26' should be the same height as the lower isolation walls 217 and the plugs 224 in the upper contact housing 48' should extend downwards to the same position as the upper isolation walls 212.

We claim:

1. An electric switch comprising:

a drive mechanism housing;

a lower contact housing fastened vertically atop the drive mechanism housing by a first fastening means;

a pair of fixed terminals located within the lower contact housing, wherein each terminal has an ear extending upward in a vertical axial plane;

an upper contact housing fastened vertically atop the lower housing by a second fastening means;

a conducting device fastened vertically atop the upper contact housing by a third fastening means, the conducting device having a pair of ears extending downward in said vertical plane through the top of the upper contact housing;

an axially translatable contact carrier between the lower and upper contact housings;

a pair of moving contacts mounted vertically on the contact carrier to engage the fixed terminals and the ears of the conducting device in said vertical axial plane; and a drive mechanism in the drive mechanism housing for sliding the axially translatable contact carrier axially, whereby the moving contacts are engaged and disengaged with the ears of the fixed terminals within the lower contact housing and the ears of the conducting device within the upper contact housing.

2. An electric switch as recited in claim 1, wherein the first fastening means is covered by the upper contact housing and the second fastening means is covered by the conducting device.

3. An electric switch as recited in claim 1, wherein the conducting device comprises a fuse carrier.

4. An electric switch as recited in claim 1, wherein the conducting device comprises a shorting circuit.

5. An electric switch as recited in claim 1, wherein:
the drive mechanism housing has a nose face with an opening therein; and
further comprising:
an auxiliary cam with a cam groove formed therein, said auxiliary cam being rotatably mounted in the drive mechanism housing so that the cam groove is exposed through the opening in the nose face of the drive mechanism housing; and
means for rotating said auxiliary cam.

6. An electric switch as recited in claim 5, wherein the cam groove receives an actuator for an auxiliary switch.

7. An electric switch as recited in claim 5, wherein the means for rotating the auxiliary cam includes:
a boss located on the top surface of said auxiliary cam; and
means on said drive mechanism for engaging said boss to rotate said auxiliary cam as said contact carrier is axially translated.

8. An electric switch as recited in claim 1 further comprising means for electrically isolating each ear in the lower and upper contact housings from other ears in the lower and upper contact housings.

9. An electric switch as recited in claim 1 wherein the second fastening means comprises a first screw fastening the periphery of the upper and lower contact housings and a second screw fastening the upper and lower contact housings inward from said first screw.

10. An electric switch as recited in claim 1, wherein:
the lower contact housing comprises:
a floor,
a pad, the pad extending upwards from the floor to a height above the top surface of the contact carrier, and
a lower longitudinal isolation wall, the lower isolation wall extending upwards from the floor to the bottom surface of the contact carrier;
the upper contact housing comprises:
a ceiling with a screw hole, and
an upper longitudinal isolation wall, the upper isolation wall extending downwards from the ceiling of the upper contact housing to the top surface of the contact carrier;
the contact carrier has:
a longitudinal hole for receiving the pad, the length of the hole being large enough to allow the contact carrier to translate axially such that the moving contacts can be engaged and disengaged with the ears of the fixed terminals within the lower contact housing and the ears of the conducting device within the upper contact housing, and
a longitudinal ridge located adjacent to the outside of the longitudinal hole, the longitudinal ridge being aligned with the upper and lower longitudinal isolation walls thereby creating a longitudinal barrier from the longitudinal hole; and
the second fastening means comprises a screw, the screw being screwed through the screw hole in the upper contact housing into the pad of the lower contact housing.

11. An electric switch, comprising:
a) a drive mechanism housing;
b) a spring support mounted in the drive mechanism housing;
c) a pin vertically abutting the spring support;
d) a drive spring;
e) a spring guide inserted through the drive spring, the spring guide having:
1) a slot through a nose of the spring guide for slidably receiving the pin;
2) means for supporting the drive spring against the pin;
3) a cylindrical journal perpendicular to the axis of the spring guide; and
4) a lip extending perpendicularly from the journal;
f) a coupling supported by the drive mechanism housing, the coupling having:
1) a base with a stepped edge for engaging the lip of the spring guide;
2) means for mounting the coupling to rotate about an operation axis;
3) a pad; and
4) a projection;
g) a handle return spring;
h) a spring compression lever having:
1) a boss;
2) a bearing for receiving the journal on the spring guide and having a buttress;
3) a chamber for receiving the pad on the coupling, the chamber being substantially wider than the pad;
4) an internal slit with a widened portion for receiving the handle return spring; and
5) a notch in the side of the spring compression lever exposing the widened portion of the slit;
the spring compression lever being mounted coaxially with the cylindrical shaft of the coupling to rotate about the operation axis so that the notch receives the projection on the coupling with the handle return spring being loaded against the projection, the chamber receives the pad, the bearing receives the journal of the spring guide, and the lip of the spring guide is fixed between the buttress of the bearing and the stepped edge of the base of the coupling whereby rotating the operating shaft causes the spring compression lever to rotate by a lost-motion and over-center action;
i) a drive cam with a slot for receiving the boss of the spring compression lever, the drive cam being supported by the spring compression lever and mounted coaxially with the cylindrical shaft of the coupling whereby rotary movement of the boss causes the drive cam to rotate; and
j) a linearly slidable drive slide for transmitting sliding motion to a contact carrier, the drive slide being coupled to the contact carrier and coupled separately to the drive cam by means of a cam transmission whereby rotary movement of the drive cam is accompanied by linear movement of the drive slide.

12. An electric switch as recited in claim 1, further comprising:
a switch state indicator located on one of said contact housings, said indicator being exposed in a corresponding state of the moving contacts relative to the ears; and
a mask carried on the contact carrier such that the mask hides the indicator when the moving contacts are in an opposite state relative to the ears.

13. An electric switch as recited in claim 12, further comprising:
a switch state indicator located on the mask corresponding to said opposite state so that said mask indicator is displayed when the moving contacts are in said opposite state relative to the ears and is hidden when the moving contacts are in said corresponding state relative to the ears.

* * * * *